US011705667B2

(12) United States Patent
Moser

(10) Patent No.: US 11,705,667 B2
(45) Date of Patent: Jul. 18, 2023

(54) TERMINAL WITH RELEASE LEVER

(71) Applicant: ELECTRO TERMINAL GMBH & CO KG, Innsbruck (AT)

(72) Inventor: Peter Moser, Stans (AT)

(73) Assignee: Electro Terminal GmbH & Co KG, Innsbruck (AT)

( * ) Notice: Subject to any disclaimer, the term of this patent is extended or adjusted under 35 U.S.C. 154(b) by 0 days.

(21) Appl. No.: 17/492,734

(22) Filed: Oct. 4, 2021

(65) Prior Publication Data

US 2022/0109271 A1 Apr. 7, 2022

(30) Foreign Application Priority Data

Oct. 6, 2020 (DE) ..... 20 2020 105 715.4

(51) Int. Cl.
*H01R 13/629* (2006.01)
*H01R 13/115* (2006.01)

(52) U.S. Cl.
CPC ..... *H01R 13/62938* (2013.01); *H01R 13/115* (2013.01)

(58) Field of Classification Search
CPC ..... H01R 13/62938; H01R 13/115; H01R 13/6271–4/4845; H01R 4/4836
See application file for complete search history.

(56) References Cited

U.S. PATENT DOCUMENTS 9,543,700 B2 1/2017 Köllmann et al.
9,825,402 B2 11/2017 Köllmann et al.
(Continued)

FOREIGN PATENT DOCUMENTS

DE 10 2014 119 420 B3 5/2016
DE 102018131757 A1 3/2020
(Continued)

OTHER PUBLICATIONS

Machine translation of DE 10 2014 119 420 B3 to Köllmann.
(Continued)

*Primary Examiner* — Vanessa Girardi
(74) *Attorney, Agent, or Firm* — The H.T. Than Law Group

(57) ABSTRACT

Terminal (1), in particular screw or connecting terminal, having a spring force terminal connection (2) with at least one conductor terminal point (K) for electrical connection of at least one conductor, an insulating material housing (6) which at least partially accommodates the spring force terminal connection (2), for each conductor terminal point (K) a conductor introduction channel (60) which extends in a conductor introduction direction (E) from the outside toward the conductor terminal point (K), and for each conductor terminal point (K) a release lever (5) which is mounted in the insulating material housing (6) pivotably about a pivot axis (A) extending transverse to the conductor introduction direction (E), in order to interact with an actuating portion (52) by pivoting of the release lever (5) with the spring force terminal connection (2) for optional opening of the conductor terminal point (K). The release lever (5) has two lever arm portions (50) which are spaced apart from one another and which are immersed on both sides of the conductor introduction channel (60) at least partially into the insulating material housing (6). The lever arm portions (50) have in each case a guide portion (53) which at least partially delimit the conductor introduction channel (60) on both sides at least in the case of a conductor terminal point (K) opened by the release lever (5). According to a first aspect, the release lever (5) has a connection portion (56) which extends along the pivot axis (A) between the lever arm portions (50) and connects these to one another. According to an alternative or additional second
(Continued)

aspect, the insulating material housing (6) has guide wall portions (63) which, together with the guide portions (53), at least partially delimit the conductor introduction channel (60), wherein the guide portions (53) are separated from the guide wall portions (63) by a gap (S).

36 Claims, 6 Drawing Sheets

(56) References Cited

U.S. PATENT DOCUMENTS

| | | | | |
|---|---|---|---|---|
| 10,418,727 | B1 * | 9/2019 | Wu | H01R 4/4827 |
| 10,505,295 | B2 | 12/2019 | Moser | |
| 11,043,759 | B2 | 6/2021 | Ober-Woerder | |

FOREIGN PATENT DOCUMENTS

| | | | |
|---|---|---|---|
| DE | 202018106899 | U1 | 3/2020 |
| DE | 102018010359 | A1 | 4/2020 |
| DE | 202015009815 | U1 | 4/2020 |
| JP | 5102480 | B2 | 12/2012 |
| JP | 5958680 | B2 | 8/2016 |

OTHER PUBLICATIONS

Machine translation of DE 10 2018 010 359 A1 to Fröbing.
European Search Report issued in connection with the corresponding European Patent Application No. 21 20 0413 dated Feb. 28, 2022.
Machine translation of DE 202015009815 U1 to Wago Verwaltungs GMBH.
Machine translation of DE 102018131757 A1 to Wu.
Machine translation of DE 20201810689910 Wago Verwaltungs GMBH.
Machine translation of JP 5102480 to Matsushita Electric Works Ltd.
Machine translation of JP 5958680 to Panasonic Electric Works Co Ltd.

* cited by examiner

TERMINAL WITH RELEASE LEVER

FIELD OF THE INVENTION

The present invention relates to a terminal and in particular a screw or connecting terminal for electrical connection of at least one electrical conductor which has a release lever for optional opening of a conductor terminal point.

BACKGROUND OF THE INVENTION

A terminal with a release lever of the above-mentioned type is known from the prior art. For mounting, the release levers are mounted rotatably in an insulating material housing of the terminal. The insulating material housing furthermore accommodates a spring force terminal connection which forms the conductor terminal point. Certain lever forces are required in order to open the conductor terminal point. In this regard, the levers are provided with a corresponding lever arm. Since the release lever is mounted in the insulating material housing, it is necessary to make the insulating material housing correspondingly stable in order to bear the lever forces. This can lead to comparatively thick-walled housing portions and thus a correspondingly large terminal. A compromise is often made in which a compact expansion in one direction of extent of the terminal involves an enlargement in a different direction of extent. For example, in the case of conductor terminal points arranged tightly next to one another for the formation of a narrow terminal, the release levers are positioned higher so that the terminal has a narrow, but high structure. Alternatively, a terminal can have an overall flatter structure if, for example, the release levers and thus the terminal are formed to be overall wider.

SUMMARY OF THE INVENTION

One object of the present invention is thus to provide a clamp of the type described above which enables an overall good compromise between a compact and simultaneously stable design with preferably as simple lever actuation as possible.

This object is achieved by the subject matter of the independent claim. The dependent claims further develop the central concept of the present invention in a particularly advantageous manner.

The present invention relates to a terminal, in particular screw or connecting terminal. The terminal has a spring force terminal connection with at least one conductor terminal point for electrical connection of at least one conductor. The terminal furthermore has an insulating material housing which at least partially accommodates the spring force terminal connection. The terminal furthermore has for each conductor terminal point a conductor introduction channel which extends in a conductor introduction direction from the outside toward the conductor terminal point. The terminal furthermore has for each conductor terminal point a release lever which is mounted in the insulating material housing pivotably about a pivot axis extending transverse to the conductor introduction direction, in order to interact with an actuating portion by pivoting of the release lever with the spring force terminal connection for optional opening of the conductor terminal point. The release lever has two lever arm portions which are spaced apart from one another and which are immersed on both sides of the conductor introduction channel at least partially into the insulating material housing. The lever arm portions have in each case a guide portion which at least partially form or delimit the conductor introduction channel on both sides at least in the case of a conductor terminal point opened by the release lever.

As a result of the provision of two lever arm portions facing one another, these can be immersed as deep as possible into the insulating material housing and thus preferably lie on both sides of the conductor introduction channel. An overall flat terminal can thus be provided. By virtue of the fact that these lever arm portions simultaneously also form or delimit a part of the conductor introduction channel over their guide portions, the terminal can be formed to be overall narrow.

According to a first aspect of the present invention, the release lever has a connection portion which extends along the pivot axis between the lever arm portions and connects these to one another.

As a result of the connection of the lever arm sections by means of a connection portion along the pivot axis, in a region under particular load, the release lever can be formed to be overall stable in order, despite the compact design, to reliably absorb the corresponding lever forces for opening the conductor terminal point. Since the connection portion is provided close to the guide portions and in this region connects the lever arm portions securely to one another, the connection portion furthermore ensures stable positioning of the guide portions. The connection portion thus prevents a lateral migration or escape of the guide portions during introduction of a conductor (for example, as a result of compressive forces of the conductor on the lateral wall of the conductor introduction channel formed by the guide portion). The guide portion thus remains securely oriented in the conductor introduction direction preferably as a smoothly running conductor introduction channel irrespective of the type of the conductor to be introduced.

According to a second aspect of the present invention, the insulating material housing has guide wall portions which, together with the guide portions, at least partially form or delimit the conductor introduction channel, wherein the guide portions are separated from the guide wall portions by a gap.

By virtue of the fact that the guide portions and the guide wall portions at least partially form or delimit the guide introduction channel, a conductor introduction channel can also be provided in the case of a compact design of the terminal for overall secure conductor introduction toward the conductor terminal point. As a result of the separation of guide portions and guide wall portions in the region of the conductor introduction channel, it is made possible to move the release lever in the region of the conductor introduction opening in a contact-free manner and thus overall reduce friction and abrasion and consequently also the actuating forces for actuating the release lever. The gap is preferably formed and dimensioned in such a manner that it does not impair the introduction of a conductor; this preferably in such a manner that it has a smaller width than the width of a conductor to be introduced. The gap particularly preferably has a width (at its narrowest point; preferably as seen in a radial direction in relation to the pivot axis) of less than 5 mm or less than 3.6 mm or less than 2.8 mm or less than 2.3 mm or less than 1.6 mm or less than 1 mm or less than 0.5 mm or less than 0.2 mm or less than 0.1 mm.

The terminal according to the first aspect can preferably also have corresponding guide wall portions of the insulating material housing which, together with the guide portions, at least partially form or delimit the conductor introduction channel, wherein the guide portions are separated from the guide wall portions preferably by the gap.

The release lever of the terminal according to the second aspect also can have a connection portion which extends along the pivot axis between the lever arm portions and connects these to one another.

The following further preferred configurations are conceivable for both aspects according to the present invention.

The release lever can preferably be separated from the guide wall portions by the gap. Since there is no physical connection between release lever on one hand and insulating material housing (or its wall portions which form the conductor introduction opening) on the other hand in any region of the conductor introduction opening, particularly easy actuation of the release lever with minimal friction can be enabled.

The conductor introduction channel preferably extends beyond the conductor terminal point in order to reliably accommodate a distal conductor end in the case of an electrical conductor connected in the conductor terminal point.

The conductor introduction channel is preferably formed closed all around as seen in the conductor introduction direction; this preferably over at least a part and preferably over its entire length from the outside up to the conductor terminal point and optionally beyond the conductor terminal point.

The guide wall portions can furthermore have lateral wall portions which at least partially laterally form or delimit the conductor introduction channel in relation to the pivot axis axially on both sides. A lateral migration of a conductor to be introduced into the conductor introduction channel can thus particularly effectively be avoided. The guide portions are preferably separated from the lateral wall portions of the guide wall portions by the gap in order to capitalize on the advantages described above of the gap in particular in this region.

The guide wall portions and preferably their lateral wall portions are preferably provided flush with the assigned guide portions of the release lever on the side of the conductor introduction channel. In this manner, a uniform conductor introduction channel can also be formed in the transition between insulating material housing and release lever. This in turn enables reliable and easy introduction of an electrical conductor into the terminal.

The lateral wall portions can preferably extend in each case substantially in a guide plane, wherein the guide portions preferably also extend substantially in the respective guide plane. The guide planes can preferably extend perpendicular to the pivot axis. An even wall of the conductor introduction channel can thus be provided and consequently an effective introduction of a conductor can be enabled.

The guide wall portions, preferably their lateral wall portions, can preferably have in each case a set back edge contour portion, into which the release lever projects in each case with one of its guide portions or actuating portions in such a manner in order to lie opposite the edge contour portion separated by the gap, preferably in each movement position of the release lever. The edge contour portion is particularly preferably formed to be arc-shaped or circular arc-shaped. Consequently, as compact a design as possible can be provided along with as constant as possible a gap width; this preferably in each movement position of the release lever.

The guide portions in each movement position of the release lever about the pivot axis can preferably at least partially form or delimit the conductor introduction channel. A secure introduction of an electrical conductor toward the conductor terminal point can consequently be enabled in each movement position of the release lever. This is preferably advantageous when, for example, rigid conductors are introduced into the conductor introduction channel even in the case of a closed release lever in order to fix it in the conductor terminal point for electrical connection.

The insulating material housing can furthermore have separating wall portions which for each conductor terminal point delimit the release lever in relation to the pivot axis axially on both sides at least partially laterally on the outside. In other words, the separating wall portions lie laterally next to the release lever as seen in the conductor introduction direction. In this manner, for example, the release lever can be securely guided laterally during its pivoting movement. The terminal can thus also have overall a particularly stable structure. The separating wall portions can furthermore contribute to a lengthening of the clearance and creepage distance.

The separating wall portions in a direction away from the conductor introduction channel at least in the case of a closed conductor terminal point (for example, in an idle position of the release lever) can preferably terminate flush with the release lever or project beyond it. In this manner, a defined and safe distance to current-conducting parts and thus preferably an adequate clearance and creepage distance can thus be provided irrespective of the pivot position of the release lever.

The separating wall portions can preferably extend in each case at least partially substantially in a separating wall plane. This separating wall plane can preferably extend perpendicular to the pivot axis. A simple construction can thus be enabled. Moreover, a separating wall portion extending in a corresponding separating wall plane can form a secure guide and lateral support for the release lever.

The guide plane and the separating wall plane can be oriented parallel to one another in each case on one side of the conductor introduction channel and furthermore preferably offset to one another by a distance. On one hand, the construction of the terminal is thus simplified overall. On the other hand, the respective portion can be provided in an expedient position for the given function by means of a corresponding lateral offset—here in particular in relation to a conductor introduction direction transversely thereto—without having a negative effect on the stability of the terminal on one hand and any required clearance and creepage distances on the other hand.

In one preferred configuration, the actuating portion can be provided substantially between the guide plane and the separating wall plane. Consequently, a space in the width of the terminal is effectively used, which leads in particular to a compact design of the terminal.

The lever arm portions can have in each case on a side facing away from the conductor introduction channel a first pivot bearing portion which interact and particularly preferably interact radially in relation to the pivot axis in each case with a corresponding second pivot bearing portion of the insulating material housing, preferably of the respectively facing separating wall portion, for pivoting about the pivot axis. As a result of the provision of the corresponding pivot bearing portions on a side of the release lever facing away from the conductor introduction channel, on one hand the release lever can be effectively and preferably mounted in the separating wall portions, while the release lever on the other hand on the side of the conductor introduction channel is provided for free configuration of the guide portion and thus of the conductor introduction channel. Moreover, the release lever is supported from the outside by the external bearing so that on one hand during actuation of the release lever as a result of the actuating and bearing forces and on the other hand during introduction of a conductor as a result of pressure of the conductor a migration of the lever arm portions or of parts thereof can be counteracted and prevented. The conductor introduction channel consequently remains securely retained even in the case of corresponding exertion or in the case of corresponding occurrence of the above-mentioned forces and ensures a reliable introduction of a conductor; preferably irrespective of the pivot position of the release lever.

The actuating portion can have the first pivot bearing portion, which leads to an overall particularly simple configuration and furthermore to effective use of space.

The actuating portion and preferably its first pivot bearing portion on one hand and the second pivot bearing portion on the other hand can radially overlap in relation to the pivot axis, in order to thus enable reliable guidance of the release lever about the pivot axis.

The first pivot bearing portion can extend away from the conductor introduction channel; this preferably parallel to the pivot axis. The first pivot bearing portion thus protrudes outward, for example, in the form of a bearing cam and thus forms a simple construction for a corresponding bearing element which can engage in a corresponding contour formed by the second pivot bearing portion in a simple and secure manner in order to enable a corresponding pivoting movement of the release lever.

The lever arm portions can have in each case on a side facing away from the conductor introduction channel one of the actuating portions. This ensures an overall particularly compact design and effective use of space of the terminal.

The actuating portion preferably extends away from the conductor introduction channel; this preferably parallel to the pivot axis. Thus, as also a correspondingly extending first pivot bearing portion, the lever arm portion can also be configured overall in order to enable an effective use of space of the terminal by virtue of the fact that precisely the correspondingly projecting portions are directed away from the conductor introduction direction so that the conductor introduction channel can also be easily formed by means of the release lever by its guide portions.

The spring force terminal connection can furthermore have a busbar and a clamping spring with a movable clamping leg. The clamping leg can have a clamping portion, preferably in the form of a clamping edge, for the formation of the conductor terminal point between the clamping portion and the busbar. In this manner, a conductor terminal point can be provided which can be easily opened by means of the release lever.

The clamping spring, more precisely the clamping leg, at least in the closed position of the conductor terminal point, as seen in the conductor introduction direction, can extend transversely through the conductor introduction channel in order to form a lead-in chamfer toward the conductor terminal point.

The clamping spring can have a bearing leg, a spring bow adjoining the bearing leg, and the clamping leg adjoining the spring bow. The clamping leg is preferably provided on a free end of the clamping spring or clamping leg facing away from the spring bow. At least the spring bow or the clamping spring can be formed to be substantially U-shaped. In this manner, a simple construction of the spring force terminal connection with a clamping spring can be provided. In one particularly preferred configuration, the clamping spring can be easily suspended in the busbar, be supported securely, for example, on the insulating material housing and provided in an easily pivotable manner, for example, via the spring bow in order to be easily moved by means of the release lever in order to optionally open the conductor terminal point. The power force terminal connection or its individual components (busbar, clamping spring) are preferably produced as stamped/bent parts, for example, from a metal sheet.

The spring force terminal connection, preferably its clamping spring, can have a spring actuating portion which is arranged in such a manner that it interacts with the actuating portion for optional opening of the conductor terminal point. The provision of a defined spring actuating portion makes it possible to separate the corresponding functional regions of the spring force terminal connection for clamping on one hand and for actuating on the other hand and thus to enable an effective configuration of the spring force terminal connection.

The spring actuating portion can extend from the clamping leg in a direction toward the release lever, this preferably laterally of the clamping leg and in the case of preferably two spring actuating portions correspondingly on both sides of the clamping leg, in order to be able to interact with the actuating portion for opening of the conductor terminal point during pivoting of the release lever about the pivot axis.

The spring actuating portion can overlap at least partially with the lever arm portions at least in the case of a closed conductor terminal point in relation to the pivot axis as seen in the axial direction. In this manner, a point of attack for opening the spring force terminal connection can be brought as close as possible to the pivot axis, which has an overall advantageous effect on the force distribution of the lever forces of the present terminal for opening the conductor terminal point by means of the release lever.

The release lever can be movable between an idle position, in which the clamping leg pushes into a closed position of the conductor terminal point, and an actuating position, in which the release lever, preferably its actuating portions, interacts in such a manner with the spring force terminal connection, preferably its clamping spring and further preferably their spring actuating portions, so that the conductor terminal point is opened. As a result of the provision of correspondingly defined positions, the use of the terminal and in particular the introduction and removal of electrical conductors can be made easier for a user. The release lever can preferably be latched detachably to the insulating material housing in the idle position; this, for example, via corresponding latching elements. The release lever can preferably likewise be retained in a defined manner in the actuating position.

The release lever can have a lever actuating portion for movement of the release lever about the pivot axis, preferably between the idle position and the actuating position. The lever actuating position can preferably extend substantially in a plane. The lever actuating portion can furthermore preferably extend between the lever arm portions and connect these to one another. In this manner, it can be formed to be particularly stable at an actuating point of attack of the release lever. The lever actuating portion furthermore offers a comfortable point of manipulation for a user. The actuating portion on one hand and the lever actuating portion on the other hand are particularly preferably provided at opposite ends of the release lever in order to thus provide a particularly advantageous distribution of the functional portions about the pivot axis in order to obtain advantageous lever arm distributions.

The pivot axis can extend laterally outside the conductor introduction channel. The pivot axis preferably does not intersect the conductor introduction channel or an elongation of the conductor introduction channel as seen in the conductor introduction direction. On one hand, space is thus created for the connection portion and the conductor introduction channel is still freely accessible. An overall stable release lever construction can thus be achieved alongside a simultaneously compact design of the terminal.

The connection portion, as seen in the axial direction, can preferably have a circular or partially circular cross-section. This is advantageous in particular when the connection portion simultaneously serves as part of a rotational mounting of the release lever and thus enables secure rotational mounting.

The connection portion can be mounted rotatably in a corresponding bearing portion of the insulating material housing about the pivot axis. The connection portion in a particularly stable region of the release lever can thus likewise also serve as a bearing receiver.

A side of the bearing portion facing away from the connection portion can preferably at least partially also form or delimit the conductor introduction channel. Consequently, the terminal can also be formed here to be particularly compact in terms of height.

For each conductor terminal point the spring force terminal connection can be at least partially covered by an outer delimiting wall of the insulating material housing on the side of the insulating material housing on which the respective release lever is arranged. The outer delimiting wall can have the bearing portion of the connection portion or the latter can extend from the delimiting wall in a direction away from the conductor introduction channel. Overall, a corresponding covering of the spring force terminal connection can thus be achieved with the delimiting wall. If the bearing portion furthermore extends from the delimiting wall away to the outside, it can furthermore serve as a spacer and thus contact protection in order to satisfy, for example, requirements in terms of a defined clearance and creepage distance.

At least one distance portion can extend from the delimiting wall in a direction away from the conductor introduction channel. The distance portion can preferably project at least partially in or through a recess of the release lever. The distance portion can furthermore terminate flush with the release lever or project beyond it preferably in a direction away from the conductor introduction channel at least in the case of a closed conductor terminal point, preferably in the idle position of the release lever. By means of distance portions formed in such a manner, it is possible to securely provide the terminal from one side, in which the release lever projects into the insulating material housing toward the spring force terminal connection, by means of corresponding contact-protection elements and thus furthermore preferably satisfy requirements in terms of clearance and creepage distances.

The spring force terminal connection can have several conductor terminal points which are preferably arranged at least partially in rows next to one another. The conductor introduction directions of the conductor introduction channels assigned to the conductor terminal points are preferably oriented at least partially parallel to one another; preferably all. A terminal with any desired number of conductor terminal points can thus be provided. It is also conceivable that several spring force terminal connections are provided in a corresponding terminal or the spring force terminal connection is formed with multiple parts or elements. The spring force terminal connection can thus have, for example, a one-piece busbar with several clamping springs for forming a corresponding number of conductor terminal points. The busbar can also be formed with multiple parts and form a corresponding number of conductor terminal points with one or some of the clamping springs.

The pivot axes of the release levers assigned to the several conductor terminal points are preferably arranged at least partially or also all coaxially, which leads to an overall compact design and simple operation of the terminal by an operator.

Respectively adjacent release levers can be axially spaced apart from one another in order to thus increase the operability thereof. Respectively adjacent release levers can be axially separated from one another at least by one of the separating wall portions so that reliable delimitation is present between the release levers despite the compact design. In each case at least one of the separating wall portions can extend at least partially between two adjacent release levers. Two adjacent release levers can subsequently also divide a joint separating wall portion so that the terminal can overall have a compact design in terms of width alongside high mechanical stability.

As seen in the axial direction, the in each case outer separating wall portions can at least partially form a lateral outer wall of the insulating material housing, which, in terms of width, in turn enables an overall compact design of the terminal.

BRIEF DESCRIPTION OF THE DRAWINGS

Further configurations and advantages of the present invention will now be described on the basis of the figures and accompanying drawings. In the drawings.

DETAILED DESCRIPTION OF THE PREFERRED EMBODIMENTS

Figure 1:
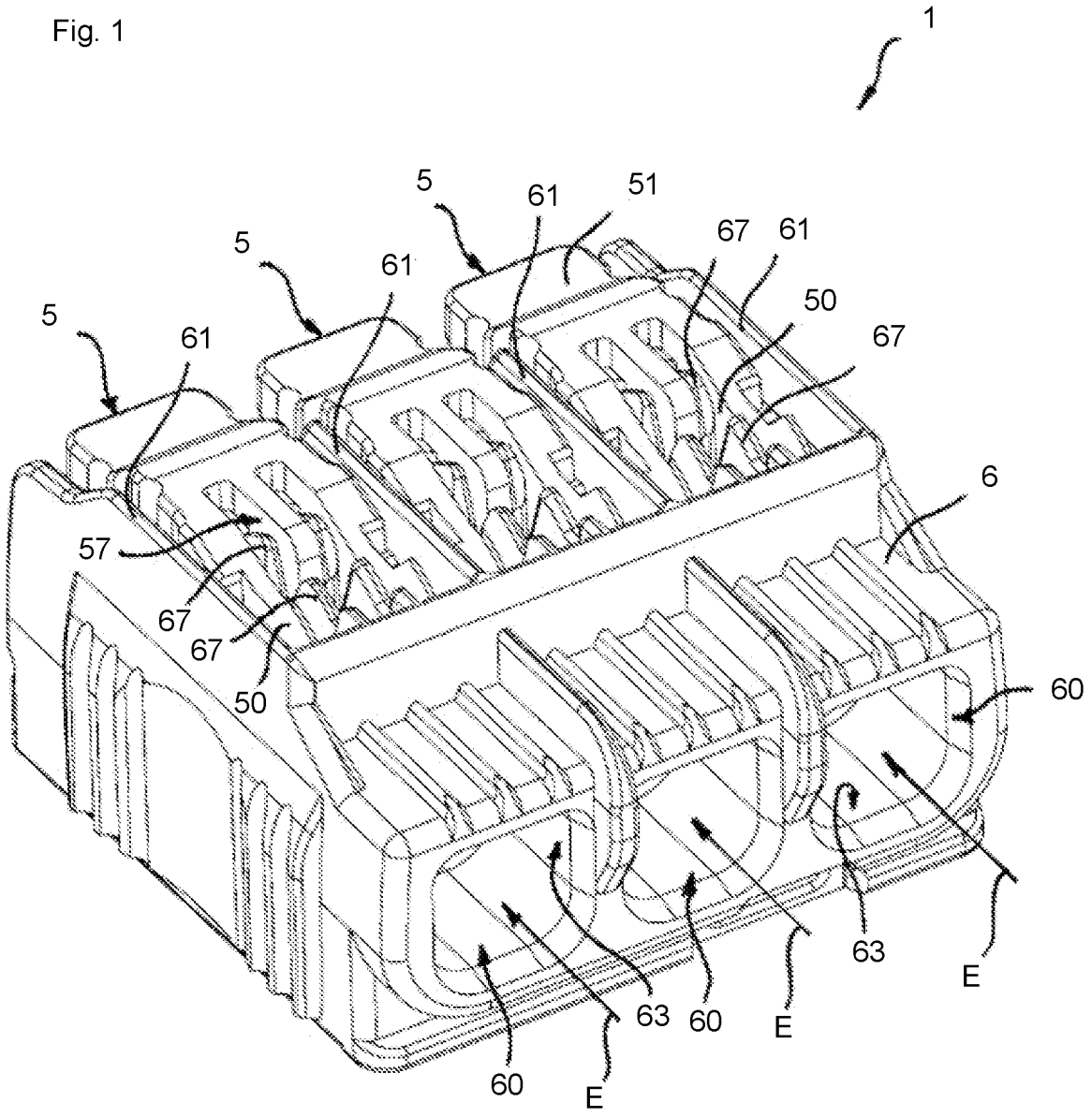
FIG. 1 shows a perspective representation of a terminal according to the invention.

The figures show different views and details of a terminal 1, in particular of a screw or connecting terminal, according to the present invention.

Terminal 1 has in this case a spring force terminal connection 2 with at least one conductor terminal point K for electrical connection of at least one conductor. Spring force terminal connection 2 preferably has, as represented, a busbar 3 and a clamping spring 4 with a movable clamping leg 42. Clamping leg 42 in turn preferably has a clamping portion 421, here preferably in the form of a clamping edge, for the formation of conductor terminal point K between clamping portion 421 and busbar 3.

Clamping spring 4 can, as represented, have a bearing leg 40, a spring bow 41 adjoining bearing leg 40, and clamping leg 42 adjoining spring bow 41. Clamping portion 421 can preferably be provided on a free end of clamping spring 4 or clamping leg 42 facing away from spring bow 41. At least spring bow 41 or clamping spring 4 can be formed overall to be substantially U-shaped.

Terminal 1 furthermore has an insulating material housing 6 which at least partially accommodates spring force terminal connection 2. Insulating material housing 6 is produced from an electrically non-conductive material, such as plastic. This preferably in an injection molding process. Insulating material housing 6 can preferably be formed in one piece or preferably in several pieces here. In the case of a multi-piece formation, the corresponding parts of the insulating material housing can be connected detachably or non-detachably to one another, for example, by means of corresponding latching elements and/or welding.

For each conductor terminal point K, terminal 1 furthermore has a conductor introduction channel 60 which extends in a conductor introduction direction E from the outside toward conductor terminal point K. As is also described below, conductor introduction channel 60 can be formed or delimited by different regions and portions of terminal 1.

As can be inferred from the exemplary embodiment, spring force terminal connection 2 can have several conductor terminal points K. These are preferably arranged at least partially or, as shown, all in a row next to one another. Conductor introduction directions E of conductor introduction channels 60 assigned to conductor terminal points K are preferably oriented at least partially or, as represented here, all parallel to one another. In the latter case, user-friendly accessibility of terminal 1 would only be provided from one side.

As can be further inferred from FIGS. 1 to 10, terminal 1 has for each conductor terminal point K a release lever 5 which is mounted in insulating material housing 6 pivotably about a pivot axis A extending transverse to conductor introduction direction E, in order to interact with an actuating portion 52 by pivoting of release lever 5 with spring force terminal connection 2 for optional opening of conductor terminal point K.

Release lever 5 can, as represented, be movable preferably between an idle position (cf. FIGS. 1, 2, 4, 5 and 8), in which terminal leg 42 pushes into a closed position of conductor terminal point K, and an actuating position (cf. FIGS. 3, 6, 7 and 10), in which release lever 5, preferably its actuating portions 52, interacts in such a manner with the spring force terminal connection 2 and preferably its terminal spring 4 so that conductor terminal point K is opened.

Figure 2:
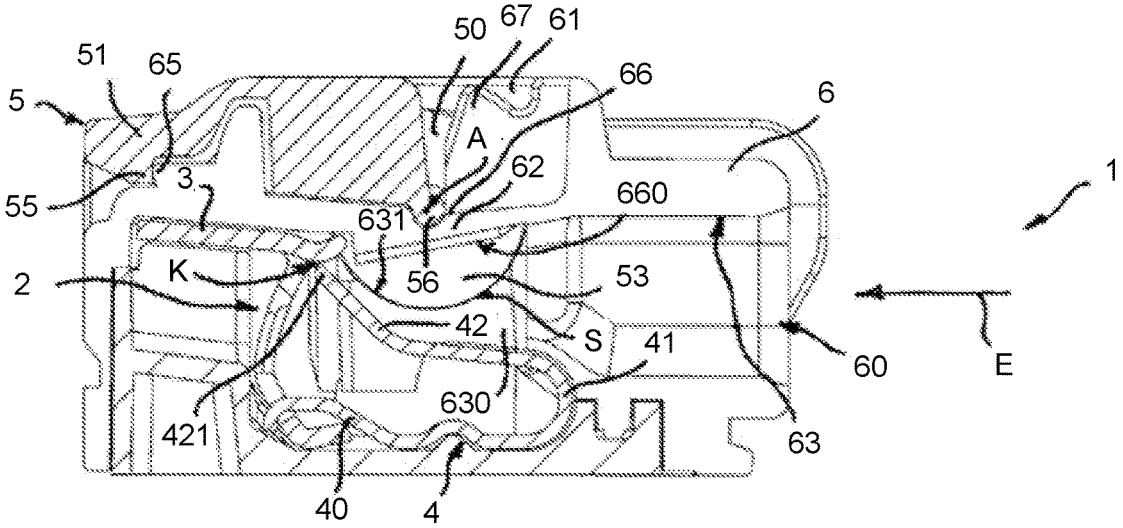
FIG. 2 shows a lateral sectional view of the terminal according to the invention according to FIG. 1 with a closed release lever.

In the idle position, release lever 5 can preferably be locked with insulating material housing 6 by means of corresponding latching elements 55, 65 to one another in a detachably latching manner, as can be inferred, for example, from FIG. 2.

Release lever 5 can have a lever actuating portion 51 for movement of release lever 5 about its pivot axis A, preferably between the idle position and the actuating position. Lever actuating position 51 can preferably extend substantially in a plane. Actuating portion 52 and lever actuating portion 51 are particularly preferably provided at opposite ends of release lever 5, as can be inferred in particular from FIGS. 4 to 10.

As can be inferred in particular from FIGS. 2 to 4 and 6, pivot axis A preferably extends laterally outside conductor introduction channel 60 and here above thereof. Pivot axis A consequently does not intersect conductor introduction channel 60 or an elongation of conductor introduction channel 60 as seen in conductor introduction direction E.

Release lever 5 has two lever arm portions 50 which are spaced apart from one another and which are immersed here on both sides of conductor introduction channel 60 (i.e. seen here in conductor introduction direction E) at least partially into insulating material housing 6, as can be inferred in particular from the sectional representations of FIGS. 2 to 7.

Figure 3:
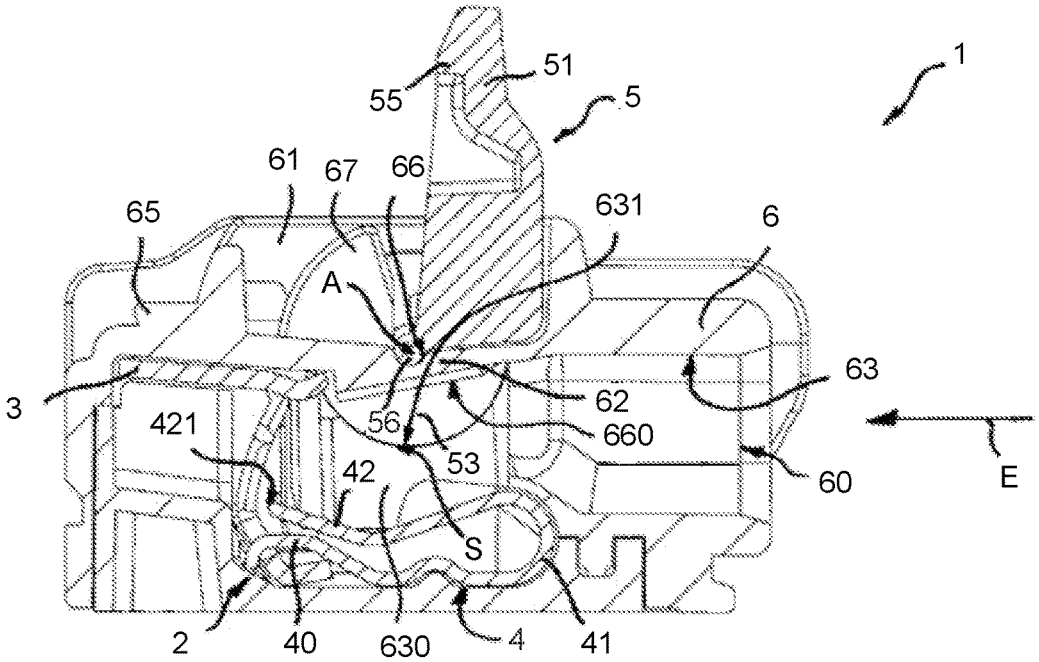
FIG. 3 shows a lateral sectional view of the terminal according to the invention according to FIG. 1 with an opened release lever.
Figure 4:
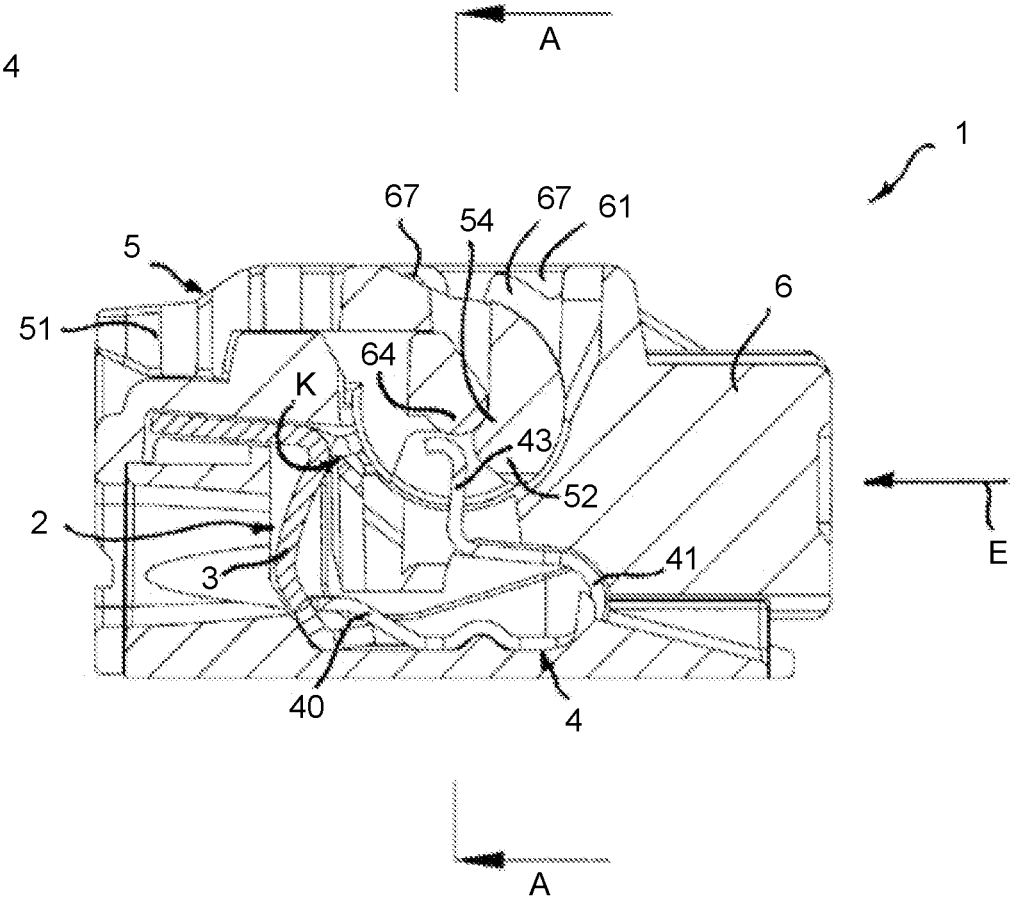
FIG. 4 shows a further lateral sectional view of the terminal according to the invention according to FIG. 1 with a closed release lever.
Figure 5:
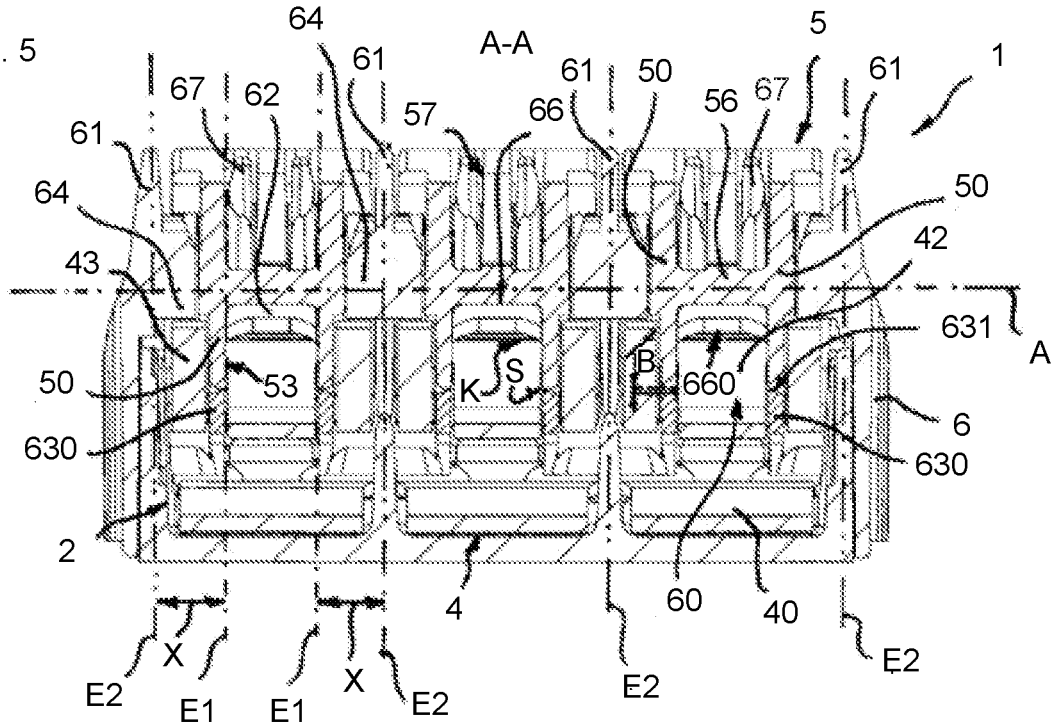
FIG. 5 shows a frontal sectional view through sectional line A-A of FIG. 4 of the terminal according to the invention.
Figure 6:
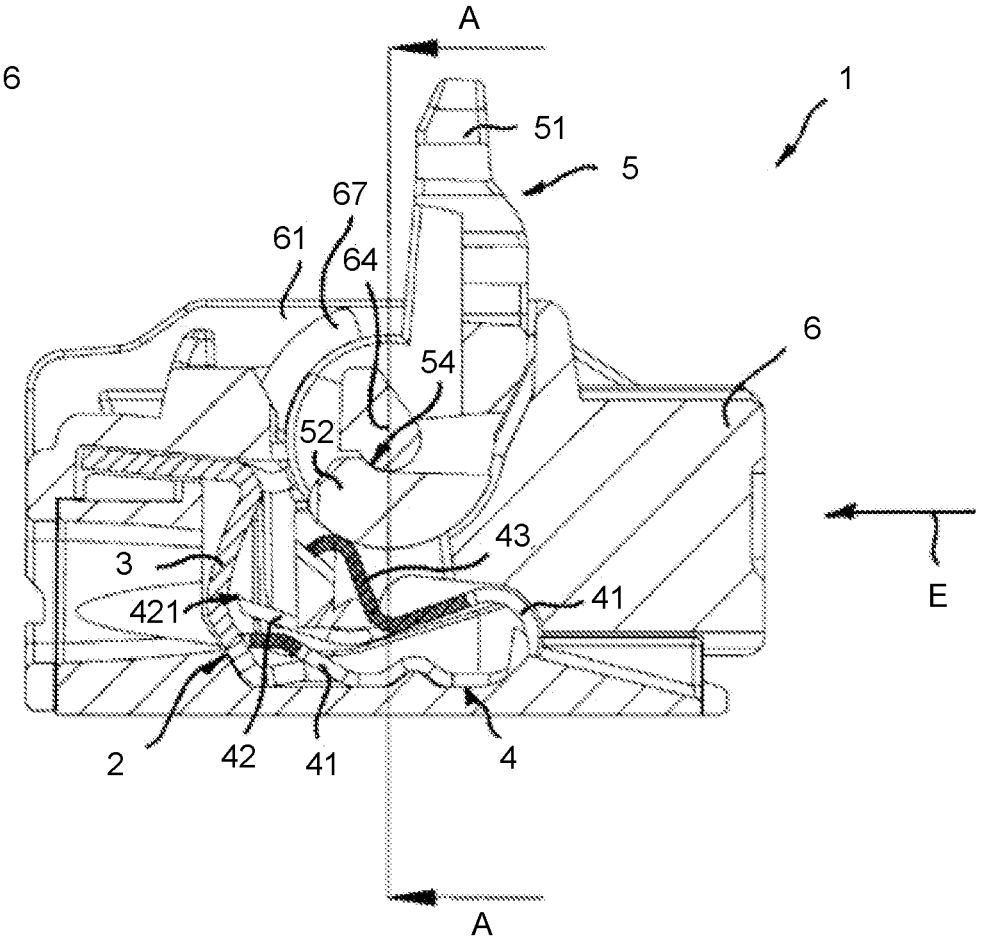
FIG. 6 shows a further lateral sectional view of the terminal according to the invention according to FIG. 1 with an opened release lever.
Figure 7:
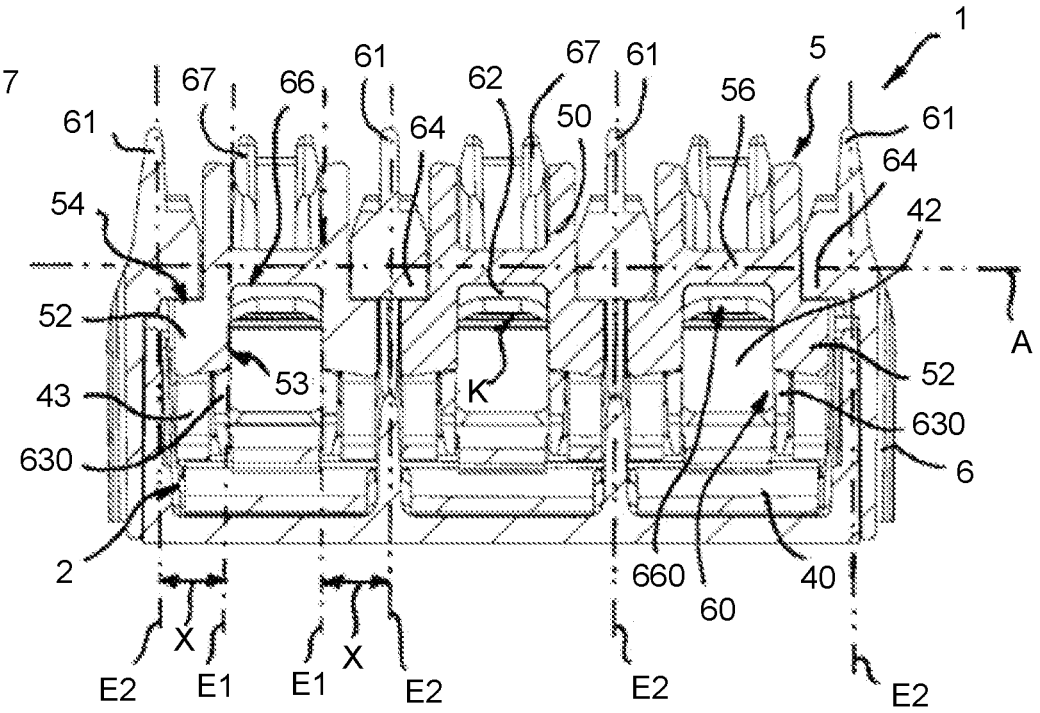
FIG. 7 shows a frontal sectional view through section A-A of FIG. 6 of the terminal according to the invention.
Figure 8:
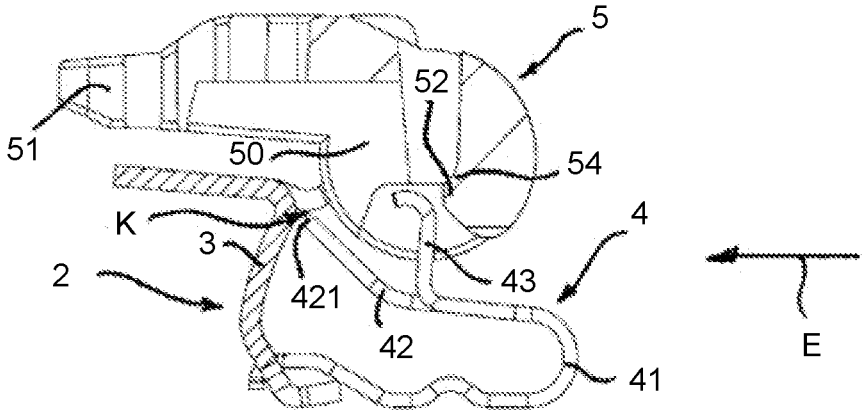
FIG. 8 shows a lateral partial sectional view of a spring force terminal connection and a release lever of the terminal according to the invention according to FIG. 1.
Figure 9:
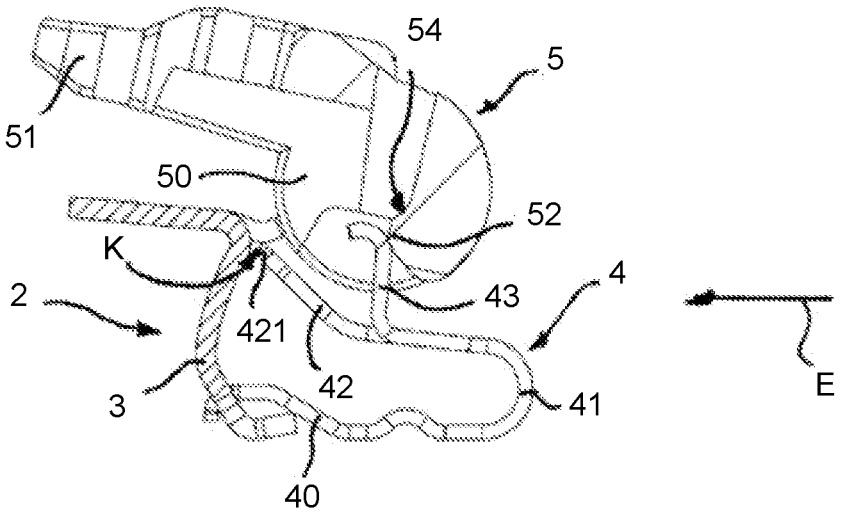
FIG. 9 shows the spring force terminal connection and the release lever according to FIG. 8 in a slightly opened position.

Lever arm portions 50 have in each case a guide portion 53 which at least partially form or delimit conductor introduction channel 60 on both sides at least in the case of a conductor terminal point K opened by release lever 5 (cf. for example FIGS. 3, 6 and 7). It is also conceivable that guide portions 53 at least partially form or delimit conductor introduction channel 60 also in each movement position of release lever 5 about pivot axis A, as can be inferred, for example, additionally from FIGS. 2, 4 and 5.

Insulating material housing 6 can furthermore have guide wall portions 63 which, together with guide portions 53, at least partially form or delimit conductor introduction channel 60. Guide wall portions 63 can have lateral wall portions 630 which at least partially laterally delimit conductor introduction channel 60 in relation to pivot axis A axially on both sides, as can be inferred, for example, from the representations of FIGS. 6 and 7. Lateral wall portions 630 can preferably be provided flush with guide portion 53 at least on the side of conductor introduction channel 60, these particularly preferably extending in a planar manner into one another.

Lateral wall portions 630 preferably extend in each case substantially in a guide plane E1. Guide portions 53 likewise extend preferably substantially in respective guide plane E1. Guide planes E1 particularly preferably extend perpendicular to pivot axis A. Guide planes E1 are particularly preferably formed parallel to one another.

Guide portions 53 can preferably be separated from guide wall portions 63 by a gap S (cf. for example FIGS. 2, 3, 5). Guide portions 53 are particularly preferably separated from lateral wall portions 630 of guide wall portions 63 by gap S. Release lever 5 is very particularly preferably separated from guide wall portions 63 by gap S. Release lever 5 is consequently freely pivotable with respect to the conductor introduction channel-side part of insulating material housing 6. Gap S is preferably formed and dimensioned such that it does not impair the introduction of a conductor; this preferably in such a manner that it has a smaller width B than the width of a conductor to be introduced. Gap S particularly preferably has a width B (at its narrowest point; preferably as seen in a radial direction in relation to pivot axis A) of less than 5 mm or less than 3.6 mm or less than 2.8 mm or less than 2.3 mm or less than 1.6 mm or less than 1 mm or less than 0.5 mm or less than 0.2 mm or less than 0.1 mm auf.

Guide wall portions 63, preferably their lateral wall portions 630, preferably have in each case a set back edge contour portion 631, into which release lever 5 projects in each case with one of its guide portions 53 or actuating portions 52 in such a manner in order to lie opposite edge contour portion 631 separated by gap S; this preferably in each movement position of release lever 5. Edge contour portion 631 is preferably formed to be arc-shaped or circular arc-shaped. The part of release lever 5 which projects into edge contour portion 631, i.e. preferably guide portions 53 or actuating portions 52 particularly preferably have a contour which corresponds to the contour of edge contour portion 631 and which likewise can be formed to be arc-shaped or circular arc-shaped (cf. for example FIGS. 2 and 3).

Release lever 5 furthermore preferably has a connection portion 56 which extends along pivot axis A between lever arm portions 50 and connects these to one another, as can be inferred, for example, from FIGS. 5 and 7.

Connection portion 56 can, as seen in the axial direction in relation to pivot axis A, preferably have a circular or partially circular cross-section, as can be inferred, for example, from FIGS. 2 and 3.

As can be inferred from these representations and furthermore from FIGS. 1, 5 and 7, connection portion 56 can preferably be mounted rotatably in a corresponding bearing portion 66 of insulating material housing 6 about pivot axis A. As can be inferred in particular from FIGS. 5 and 7, a side 660 of bearing portion 66 facing away from connection portion 56 can furthermore preferably at least partially form or delimit conductor introduction channel 60.

For each conductor terminal point K spring force terminal connection 2 is at least partially covered by an outer (here upper) delimiting wall 62 of insulating material housing 6 on the side of insulating material housing 6 on which respective release lever 5 is arranged, as can be inferred, for example, from FIGS. 2 and 3.

At least one distance portion 67 can extend from delimiting wall 62 in a direction away from conductor introduction channel 60. Distance portion 67 can preferably project at least partially in or through a recess 57 of the release lever. This recess 57 can be formed, for example, between the individual elements of release lever 5, such as lever arm portions 50, lever actuating portion 51 and connection portion 56. Distance portion 67 can preferably terminate flush with release lever 5 or project beyond it preferably in a direction away from conductor introduction channel 60 at least in the case of a closed conductor terminal point K, or also be (slightly) set back, as can be inferred, for example, from FIG. 5. The size of corresponding distance portions 67 is determined, for example, according to the adherence to desired clearance and creepage distances.

Insulating material housing 6 can furthermore have separating wall portions 61 which for each conductor terminal point K delimit release lever 5 in relation to pivot axis A axially on both sides at least partially laterally on the outside. Separating wall portions 61 can in a direction away from conductor introduction channel 60 at least in the case of a closed conductor terminal point K terminate flush with release lever 5 or project beyond it or also possibly be set back therefrom. In the exemplary embodiments represented here, a flush orientation is represented, as can be inferred, for example, from FIG. 5. Separating wall portions 61 can extend in each case at least partially substantially in a separating wall plane E2, wherein separating wall plane E2 preferably extends perpendicular to pivot axis A. As can be inferred in particular from FIGS. 5 and 7, guide plane E1 and separating wall plane E2 can be oriented in each case on one side of conductor introduction channel 60 parallel to one another and preferably be offset to one another by a distance X. Actuating portion 52 can preferably be provided substantially between guide plane E1 and separating wall plane E2, as can be inferred, for example, from FIG. 7.

Lever arm portions 50 preferably have in each case on a side facing away from conductor introduction channel 60 a first pivot bearing portion 54 which interact; preferably interact radially in relation to pivot axis A, in each case with a corresponding second pivot bearing portion 64 of insulating material housing 6, preferably of respectively facing separating wall portion 61, for pivoting about pivot axis A. This is also clearly apparent from FIG. 7 and can also be seen in FIGS. 4 and 6.

In one preferred configuration, actuating portion 52 can have first pivot bearing portion 54. In the exemplary embodiment represented here, these are formed as an integrally projecting cam.

Actuating portion 52, preferably its first pivot bearing portion 54, and second pivot bearing portion 64 can radially overlap in relation to pivot axis A, as can be inferred from FIG. 7. In this manner, secure support of release lever 5 in insulating material housing 6 can be brought about.

First pivot bearing portion 54 preferably extends laterally away from conductor introduction channel 60 here, preferably parallel to pivot axis A, as can be inferred in turn from FIG. 7.

Lever arm portions 50 can have in each case on a side facing away from conductor introduction channel 60 one of actuating portions 52. Actuating portion 52 can extend laterally away from conductor introduction channel 60 here, preferably parallel to pivot axis A.

As can be inferred in particular from FIGS. 2, 4, 5 and 11 to 13, terminal spring 4 at least in the closed position of conductor terminal point K, as seen in conductor introduction direction E, can extend transversely through conductor introduction channel 60 in order to form a lead-in chamfer toward conductor terminal point K.

Spring force terminal connection 2, in particular its terminal spring 4, can have a spring actuating portion 43 which is arranged in such a manner that it interacts with actuating portion 52 for optional opening of conductor terminal point K. Spring actuating portion 43 extends from clamping leg 42 in a direction toward release lever 5, as can be clearly inferred, for example, from FIG. 4. Spring actuating portion 43 preferably extends laterally of clamping leg 42, particularly preferably, as can be inferred, for example, from FIG. 13, two spring actuating portions 43 for each clamping spring 4 provided here correspondingly extend on both sides of clamping leg 42 of associated clamping spring 4. This in order to be able to interact with actuating portion 50 for opening of conductor terminal point K during pivoting of release lever 5 about pivot axis A. How this interaction occurs is clearly apparent from FIGS. 8 to 10.

Actuating portions 52, which are in each case opposite one of spring actuating portions 43, are moved by the pivoting movement of release lever 5 about pivot axis A in a circular path about precisely this pivot axis A. Spring actuating portion 43 overlaps, as can be inferred, for example, from FIGS. 4 and 8, at least in the case of closed conductor terminal point K in relation to pivot axis A, as seen in the axial direction, at least partially with lever arm portions 50. Corresponding spring actuating portion 43, in the case of corresponding pivoting movement of actuating portion 52, consequently lies in the way of the latter and is consequently, as can be inferred from the sequence of FIGS.

Figure 10:
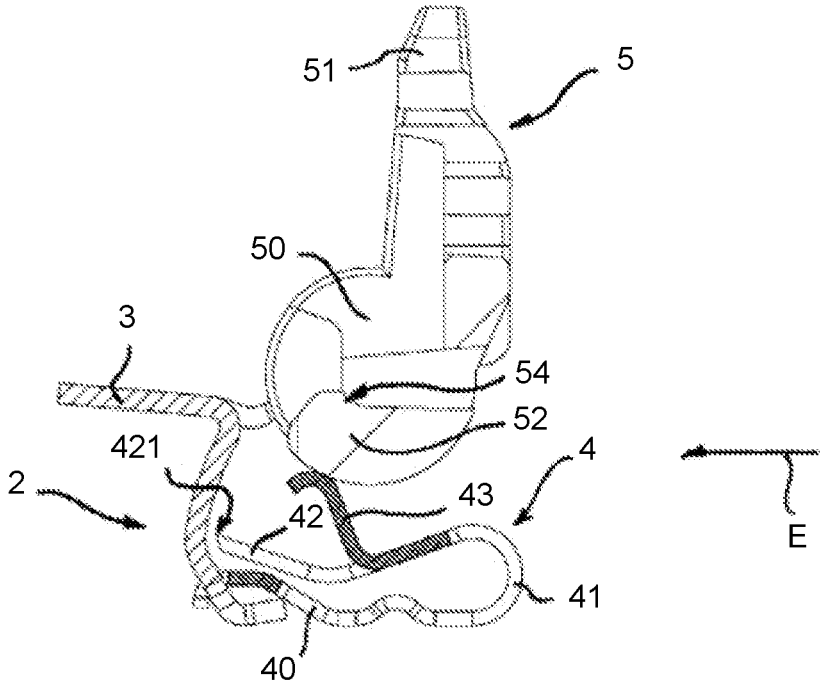
FIG. 10 shows the spring force terminal connection and the release lever according to FIG. 8 in the case of an opened release lever.
Figure 11:
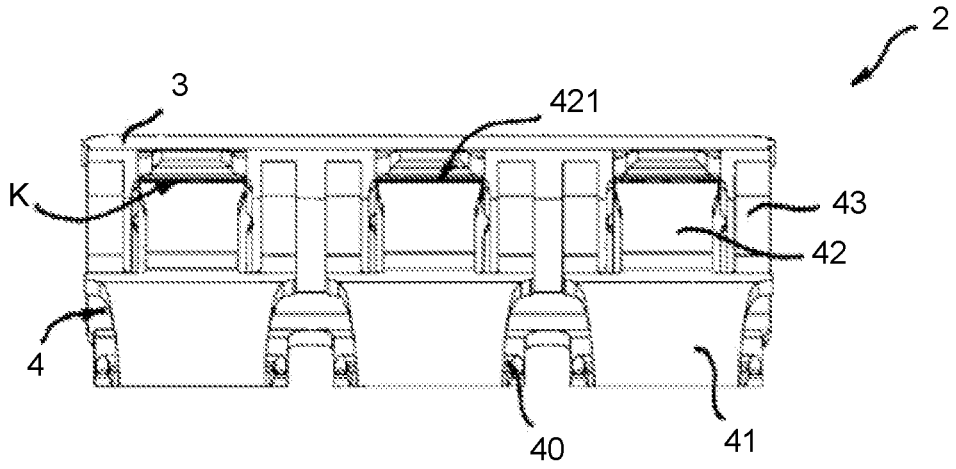
FIG. 11 shows a frontal view of a spring force terminal connection of the terminal according to the invention according to FIG. 1.
Figure 12:
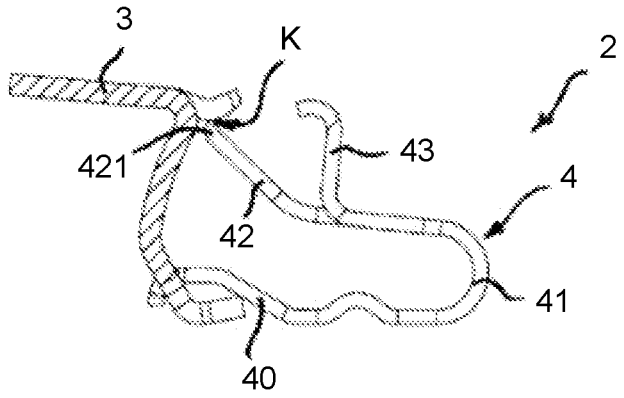
FIG. 12 shows a lateral sectional view of the spring force terminal connection according to FIG. 11.
Figure 13:
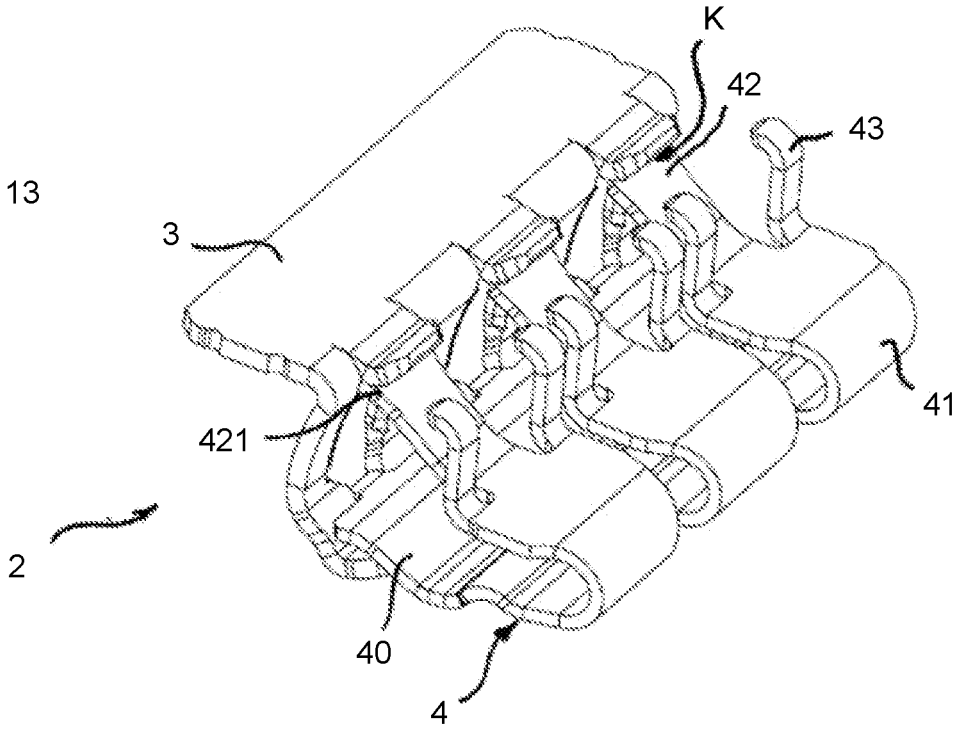
FIG. 13 shows a perspective view of the spring force terminal connection according to FIG. 11.

9 and 10, displaced and thus manipulated (i.e. moved or pivoted). As a result, terminal leg 42, as can be inferred from FIG. 10, is pivoted downward and consequently conductor terminal point K is opened. Since spring actuating portion 43 projects correspondingly high here, release lever 5 does not have to immerse correspondingly deep into insulating material housing 6, with the result that the lever itself can be formed to be overall largely flat, while at the same time simple and reliable operation as well as optional opening of conductor terminal point K are enabled.

It is furthermore apparent with reference to FIG. 1 that lever actuating portion 51, as also connection portion 56, preferably extends between lever arm portions 50 and connects these to one another. An overall stable release lever 5 is thus provided.

In the represented exemplary embodiment, the terminal has a spring force terminal connection 2 with several conductor terminal points K. Spring force terminal connection 2 can be formed as a coherent part; this preferably with integral busbar 2 and number of clamping springs 4 which corresponds to conductor terminal points K. It is also possible that spring force terminal connection 2 is formed with multiple parts or elements and each part has in each case one or a group of conductor terminal points K. In this regard, for example, several busbars 2 can be provided with in each case one or a group of clamping springs 4 for the formation of a corresponding number of conductor terminal points K.

Pivot axes A of release levers 5 assigned to several conductor terminal points K are preferably arranged at least partially coaxially. In the represented exemplary embodiment, pivot axes A of all release levers 5 are arranged coaxially to one another.

Respectively adjacent release levers 5 can preferably be axially spaced apart from one another, as can be inferred, for example, from FIG. 1 and the sectional representations of FIGS. 5 and 7. Respectively adjacent release levers 5 can be axially separated from one another at least by one of separating wall portions 50. In each case at least one of separating wall portions 50 can extend at least partially between two adjacent release levers 5, as can be inferred, for example, from FIGS. 1, 5 and 7. By virtue of the fact that in each case two adjacent release levers 5 divide a joint separating wall portion 50, an overall particularly compact and simultaneously stable design of terminal 1 can be achieved.

As can be inferred in particular from FIG. 1, as seen in the axial direction in relation to pivot axis A, in each case outermost separating wall portions 50 can form at least partially a lateral outer wall of insulating material housing 6.

The present invention is not restricted by the preceding exemplary embodiment insofar as it is encompassed by the subject matter of the following claims.

The invention claimed is:

1. Terminal (1), in particular screw or connecting terminal, having:

a spring force terminal connection (2) with at least one conductor terminal point (K) for electrical connection of at least one conductor, an insulating material housing (6) which at least partially accommodates the spring force terminal connection (2), for each conductor terminal point (K) a conductor introduction channel (60) which extends in a conductor introduction direction (E) from the outside toward the conductor terminal point (K), and for each conductor terminal point (K) a release lever (5) which is mounted in the insulating material housing (6) pivotably about a pivot axis (A) extending transverse to the conductor introduction direction (E), in order to interact with an actuating portion (52) by pivoting of the release lever (5) with the spring force terminal connection (2) for optional opening of the conductor terminal point (K), wherein the release lever (5) has two lever arm portions (50) which are spaced apart from one another and which are immersed on both sides of the conductor introduction channel (60) at least partially into the insulating material housing (6), wherein the lever arm portions (50) have in each case a guide portion (53) which at least partially delimit the conductor introduction channel (60) on both sides at least in the case of a conductor terminal point (K) opened by the release lever (5), wherein the release lever (5) has a connection portion (56) which extends along the pivot axis (A) between the lever arm portions (50) and connects these to one another, and wherein the lever arm portions (50) have in each case on a side facing away from the conductor introduction channel (60) one of the actuating portions (52), wherein the actuating portion (52) has a first pivot bearing portion (54).

2. Terminal (1), in particular screw or connecting terminal, having:

a spring force terminal connection (2) with at least one conductor terminal point (K) for electrical connection of at least one conductor, an insulating material housing (6) which at least partially accommodates the spring force terminal connection (2), for each conductor terminal point (K) a conductor introduction channel (60) which extends in a conductor introduction direction (E) from the outside toward the conductor terminal point (K), and for each conductor terminal point (K) a release lever (5) which is mounted in the insulating material housing (6) pivotably about a pivot axis (A) extending transverse to the conductor introduction direction (E), in order to interact with an actuating portion (52) by pivoting of the release lever (5) with the spring force terminal connection (2) for optional opening of the conductor terminal point (K), wherein the release lever (5) has two lever arm portions (50) which are spaced apart from one another and which are immersed on both sides of the conductor introduction channel (60) at least partially into the insulating material housing (6), wherein the lever arm portions (50) have in each case a guide portion (53) which at least partially delimit the conductor introduction channel (60) on both sides at least in the case of a conductor terminal point (K) opened by the release lever (5), wherein the release lever (5) has a connection portion (56) which extends along the pivot axis (A) between the lever arm portions (50) and connects these to one another, and wherein the actuating portion (52) extends away from the conductor introduction channel (60) parallel to the pivot axis (A).

3. Terminal (1) according to claim 2, wherein the insulating material housing (6) has guide wall portions (63) which, together with the guide portions (53), at least partially delimit the conductor introduction channel (60), wherein the guide portions (53) are separated from the guide wall portions (63).

4. Terminal (1), in particular screw or connecting terminal, having:

a spring force terminal connection (2) with at least one conductor terminal point (K) for electrical connection of at least one conductor, an insulating material housing (6) which at least partially accommodates the spring force terminal connection (2), for each conductor terminal point (K) a conductor introduction channel (60) which extends in a conductor introduction direction (E) from the outside toward the conductor terminal point (K), and for each conductor terminal point (K) a release lever (5) which is mounted in the insulating material housing (6) pivotably about a pivot axis (A) extending transverse to the conductor introduction direction (E), in order to interact with an actuating portion (52) by pivoting of the release lever (5) with the spring force terminal connection (2) for optional opening of the conductor terminal point (K), wherein the release lever (5) has two lever arm portions (50) which are spaced apart from one another and which are immersed on both sides of the conductor introduction channel (60) at least partially into the insulating material housing (6), wherein the lever arm portions (50) have in each case a guide portion (53) which at least partially delimit the conductor introduction channel (60) on both sides at least in the case of a conductor terminal point (K) opened by the release lever (5), wherein the insulating material housing (6) has guide wall portions (63) which, together with the guide portions (53), at least partially delimit the conductor introduction channel (60), wherein the guide portions (53) are separated from the guide wall portions (63) by a gap (S), and wherein the lever arm portions (50) have in each case on a side facing away from the conductor introduction channel (60) one of the actuating portions (52), wherein the actuating portion (52) has a first pivot bearing portion (54).

5. Terminal (1) according to claim 4, wherein the release lever (5) has a connection portion (56) which extends along the pivot axis (A) between the lever arm portions (50) and connects these to one another.

6. Terminal (1) according to claim 4, wherein the release lever (5) is separated from the guide wall portions (63) by the gap (S).

7. Terminal (1) according to claim 4, wherein the guide wall portions (63) are provided flush with the guide portion (53) at least on the side of the conductor introduction channel (60).

8. Terminal (1) according to claim 4, wherein the guide wall portions (63) have in each case a set back edge contour portion, into which the release lever (5) projects in each case with one of its guide portions (53) or actuating portions (52) in such a manner in order to lie opposite the edge contour portion separated by the gap (S).

9. Terminal (1) according to claim 4, wherein the guide portions (53) in each movement position of the release lever (5) about the pivot axis (A) at least partially delimit the conductor introduction channel (60).

10. Terminal (1) according to claim 4, wherein the actuating portion (52) extends away from the conductor introduction channel (60) parallel to the pivot axis (A).

11. Terminal (1) according to claim 4, wherein the release lever (5) has a lever actuating portion (51) for movement of the release element (5) about the pivot axis (A).

12. Terminal (1) according to claim 4, wherein the pivot axis (A) extends laterally outside the conductor introduction channel (60), and/or wherein the pivot axis (A) does not intersect the conductor introduction channel (60) or an elongation of the conductor introduction channel (60) as seen in the conductor introduction direction (E).

13. Terminal (1) according to claim 4, wherein the connection portion (56), as seen in the axial direction, has a circular or partially circular cross-section.

14. Terminal (1) according to claim 4, wherein the connection portion (56) is mounted rotatably in a corresponding bearing portion (66) of the insulating material housing (6) about the pivot axis (A).

15. Terminal (1) according to claim 4, wherein for each conductor terminal point (K) the spring force terminal connection (2) is at least partially covered by an outer delimiting wall (62) of the insulating material housing (6) on the side of the insulating material housing (6) on which the respective release lever (5) is arranged.

16. Terminal (1) according to claim 15, wherein at least one distance portion (67) extends from the delimiting wall (62) in a direction away from the conductor introduction channel (60).

17. Terminal (1) according to claim 4, wherein the spring force terminal connection (2) has several conductor terminal points (K).

18. Terminal (1) according to claim 17, wherein the pivot axes (A) of the release levers (5) assigned to the several conductor terminal points (K) are arranged at least partially coaxially.

19. Terminal (1) according to claim 4, wherein the spring force terminal connection (2), has a spring actuating portion (43) which is arranged in such a manner that it interacts with the actuating portion (52) for optional opening of the conductor terminal point (K).

20. Terminal (1) according to claim 19, wherein the spring force terminal connection (2) has a busbar (3) and a clamping spring (4) with a movable clamping leg (42), wherein the clamping leg (42) has a clamping portion (421) for the formation of the conductor terminal point (K) between the clamping portion (421) and the busbar (3), and wherein the spring actuating portion (43) extends from the clamping leg (42) in a direction toward the release lever (5) in order to be able to interact with the actuating portion (52) for opening of the conductor terminal point (K) during pivoting of the release lever (5) about the pivot axis (A).

21. Terminal (1) according to claim 19, wherein the spring actuating portion (43) overlaps at least partially with the lever arm portions (50) at least in the case of a closed conductor terminal point (K) in relation to the pivot axis (A) as seen in the axial direction.

22. Terminal (1) according to claim 4, wherein the spring force terminal connection (2) has a busbar (3) and a clamping spring (4) with a movable clamping leg (42), wherein the clamping leg (42) has a clamping portion (421) for the formation of the conductor terminal point (K) between the clamping portion (421) and the busbar (3).

23. Terminal (1) according to claim 22, wherein the clamping spring (4) at least in the closed position of the conductor terminal point (K), as seen in the conductor introduction direction (E), extends transversely through the conductor introduction channel (60) in order to form a lead-in chamfer toward the conductor terminal point (K).

24. Terminal (1) according to claim 22, wherein the clamping spring (4) has a bearing leg (40), a spring bow (41) adjoining the bearing leg (40), and the clamping leg (42) adjoining the spring bow (41), wherein at least the spring bow (41) or the clamping spring (4) is formed to be substantially U-shaped.

25. Terminal (1) according to claim 22, wherein the release lever (5) is movable between an idle position, in which the clamping leg (42) pushes into a closed position of the conductor terminal point (K), and an actuating position interacts in such a manner with the spring force terminal connection (2), so that the conductor terminal point (K) is opened.

26. Terminal (1) according to claim 4, wherein the guide wall portions (63) have lateral wall portions (630) which at least partially laterally delimit the conductor introduction channel (60) in relation to the pivot axis (A) axially on both sides.

27. Terminal (1) according to claim 26, wherein the lateral wall portions (630) extend in each case substantially in a guide plane (E1).

28. Terminal (1) according to claim 27, wherein the insulating material housing (6) has separating wall portions (61) which for each conductor terminal point (K) delimit the release lever (5) in relation to the pivot axis (A) axially on both sides at least partially laterally on the outside, wherein the separating wall portions (61) extend in each case at least partially substantially in a separating wall plane (E2), and wherein the guide plane (E1) and the separating wall plane (E2) are oriented parallel to one another in each case on one side of the conductor introduction channel (60).

29. Terminal (1) according to claim 28, wherein the actuating portion (52) is provided substantially between the guide plane (E1) and the separating wall plane (E2).

30. Terminal (1) according to claim 4, wherein the insulating material housing (6) has separating wall portions (61) which for each conductor terminal point (K) delimit the release lever (5) in relation to the pivot axis (A) axially on both sides at least partially laterally on the outside.

31. Terminal (1) according to claim 30, wherein the separating wall portions (61) in a direction away from the conductor introduction channel (60) at least in the case of a closed conductor terminal point (K) terminate flush with the release lever (5) or project beyond it.

32. Terminal (1) according to claim 30, wherein the separating wall portions (61) extend in each case at least partially substantially in a separating wall plane (E2).

33. Terminal (1) according to claim 30, wherein respectively adjacent release levers (5) are axially spaced apart from one another, and/or wherein respectively adjacent release levers (5) are axially separated from one another at least by one of the separating wall portions (61), and/or wherein in each case at least one of the separating wall portions (61) extends at least partially between two adjacent release levers (5).

34. Terminal (1) according to claim 30, wherein, as seen in the axial direction, the in each case outermost separating wall portions (61) at least partially form a lateral outer wall of the insulating material housing (6).

35. Terminal (1) according to claim 30, wherein the lever arm portions (50) have in each case on a side facing away from the conductor introduction channel (60) the first pivot bearing portion (54) which interact in each case with a corresponding second pivot bearing portion (64) of the insulating material housing (6) for pivoting about the pivot axis (A).

36. Terminal (1) according to claim 35, wherein the actuating portion (52), and the second pivot bearing portion (64) radially overlap in relation to the pivot axis (A), and/or wherein the first pivot bearing portion (54) extends away from the conductor introduction channel (60).

* * * * *